US008853512B2

(12) United States Patent
Wagner

(10) Patent No.: US 8,853,512 B2
(45) Date of Patent: Oct. 7, 2014

(54) TRUSS RODS

(71) Applicant: Pacific Western Timbers, Inc., Bremerton, WA (US)

(72) Inventor: John W. Wagner, Seabeck, WA (US)

(73) Assignee: Pacific Western Timbers, Inc., Bremerton, WA (US)

( * ) Notice: Subject to any disclaimer, the term of this patent is extended or adjusted under 35 U.S.C. 154(b) by 0 days.

(21) Appl. No.: 13/787,551

(22) Filed: Mar. 6, 2013

(65) Prior Publication Data

US 2014/0251111 A1 Sep. 11, 2014

(51) Int. Cl.
*G10D 1/08* (2006.01)
*G10D 3/06* (2006.01)

(52) U.S. Cl.
CPC ..... *G10D 3/06* (2013.01)
USPC ..... 84/312 R

(58) Field of Classification Search
USPC ..... 84/267, 312 R, 293, 290
See application file for complete search history.

(56) References Cited

U.S. PATENT DOCUMENTS 5,233,122 A * 8/1993 Kim ..... 84/293
7,507,887 B1 * 3/2009 Blanchard ..... 84/293

* cited by examiner

*Primary Examiner* — Kimberly Lockett
(74) *Attorney, Agent, or Firm* — Davis Wright Tremaine LLP; Michael J. Donohue; Heather M. Colburn

(57) ABSTRACT

A truss rod for use with a neck body of a musical instrument. The truss rod includes a first rod connected to a second rod. An adjustment member is connected to the first rod and configured to exert a longitudinally directed force on the first rod that causes the first rod to move longitudinally with respect to the second rod. This movement exerts a laterally directed force on the second rod that causes the second rod to exert a laterally directed force on the neck body to thereby change the curvature of the neck body. The adjustment member may threadedly engage the first rod and exert the longitudinally directed force on the first rod by threading into or out of the first rod. The adjustment member may also threadedly engage the second rod. Different thread pitches may be used to threadedly engage the adjustment member with the first and second rods.

23 Claims, 10 Drawing Sheets

TRUSS RODS

BACKGROUND OF THE INVENTION

1. Field of the Invention

The present invention is directed generally to truss rods that are installable in necks of stringed musical instruments, such as guitars.

2. Description of the Related Art

Many stringed instruments (such as guitars, bases, cellos, violins, violas, and the like) have a body portion connected to a neck. The body portion and neck are typically constructed from wood. The neck may include a fingerboard on which a plurality of spaced apart frets may be distributed lengthwise. A plurality of stings are attached at one end to a distal portion (sometimes referred to as a "headstock" or "peg head") of the neck, and at the other end to the body portion of the instrument. Tension is imparted into the strings (often by tuning pegs). Unfortunately, this tension may bend the neck such that the neck curves away from the strings (referred to herein as a "backward" direction). In other words, when viewed from the front, the neck may curve concavely.

A truss rod may be installed in the neck under the fingerboard to help counteract the tension on the neck imparted by strings (or other external forces) and prevent the neck from bending. Thus, the truss rod may help maintain a desired amount of curvature (or relief) in the neck.

As a stringed instrument (e.g., a guitar) ages or is played, the wood shifts, warps, expands, contracts, and/or flexes. This movement may cause changes in the curvature of the neck. In some cases, the curvature in the neck may be adjusted to some extent by adjusting the truss rod. However, the adjustment options provided by many prior art truss rods are limited and may not be sufficient to adjust the neck into a desired shape.

For example, many prior art truss rods are configured to adjust the curvature of the neck along only a single direction (e.g., in a direction toward the strings, referred to herein as a "forward" direction). Such truss rods are commonly referred to as "single action" truss rods. Single action truss rods are effective only when the neck is bent in a direction opposite the single direction in which the truss rod is configured to adjust the curvature of the neck. Unfortunately, the neck may be bent in any direction, including toward the strings (the "forward" direction), away from the strings (the "backward" direction), sideways in a first direction (referred to herein as a "right" direction), and/or sideways in a second direction (referred to herein as a "left" direction) that is opposite the right direction. The terms "forward," "backward," "right," and "left" have been assigned arbitrarily for the purposes of describing the bending of the neck of the instrument. As is apparent to those of ordinary skill in the art, the neck may be bent in a single direction, more than one direction, and/or twisted.

A "double action" truss rod is configured to bend the neck in two directions (e.g., the forward and backward directions). Although some double action truss rods are currently available, they bend only in the middle and only in an arc-like shape. Thus, they cannot be adjusted at a specific fret along the neck of the instrument. In addition, these prior art double action truss rods are not configured to hold the neck straight with respect to the right and/or left directions. For example, many conventional truss rods have a round cross-sectional shape that allows them to rotate inside the neck of an instrument. Such "double action" truss rods allow the neck to twist and/or bend in the right and/or left directions, which may permanently ruin the instrument. This type of failure may occur during the manufacturing phase or during the life of the instrument. Further, prior art double action truss rods are both bulky and heavy, which adds undesirable weight to musical instruments. Increased weight negatively affects the playability of an instrument.

Therefore, a need exists for new double action truss rod designs. Lighter weight, less bulky truss rods would be particularly desirable. Truss rods configured to hold the neck straight in the right and left directions are also desirable. The present application provides these and other advantages as will be apparent from the following detailed description and accompanying figures.

BRIEF DESCRIPTION OF THE SEVERAL VIEWS OF THE DRAWING(S)

DETAILED DESCRIPTION OF THE INVENTION

Figure 1:
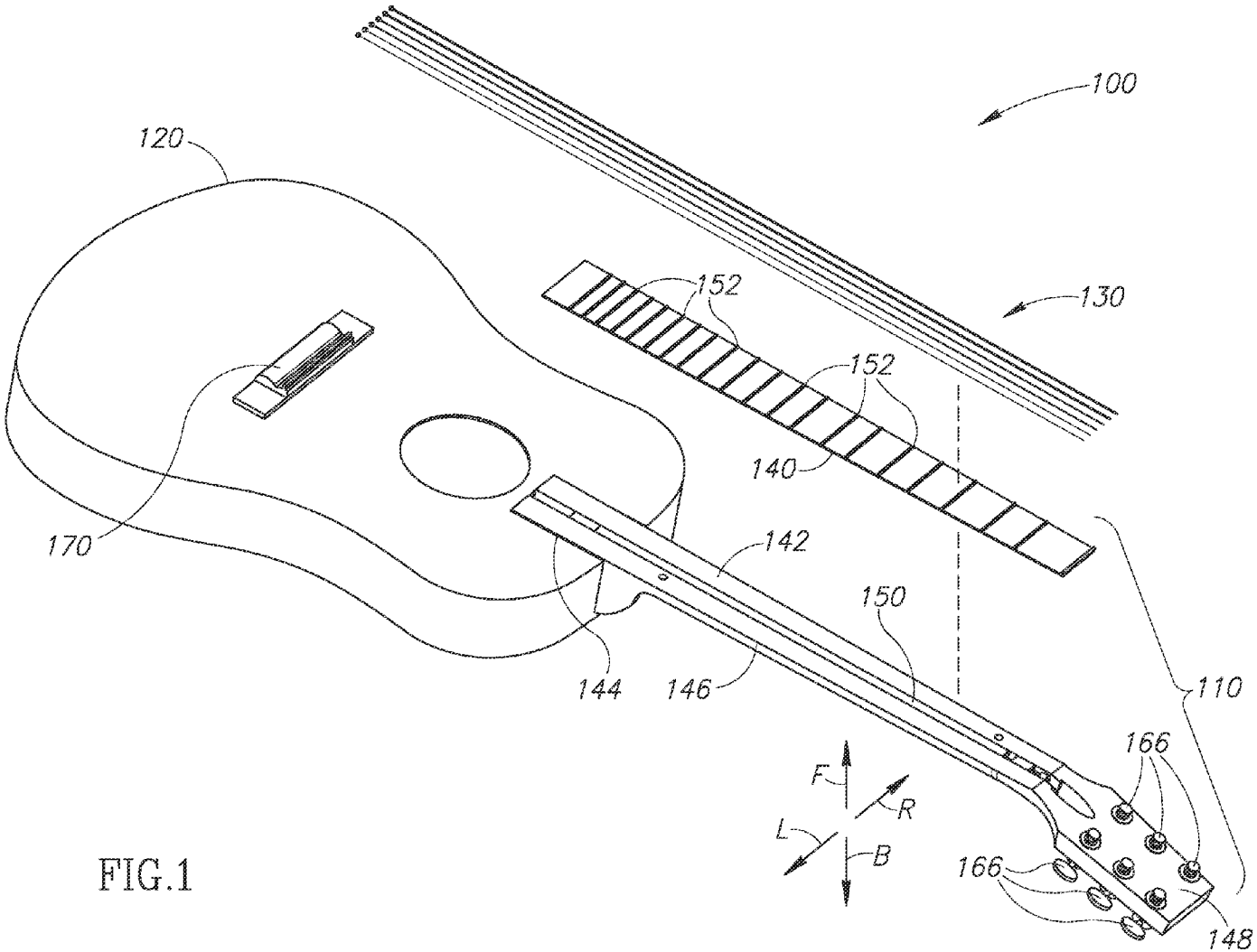
FIG. 1 is a partially exploded perspective view of a fretted and stringed instrument including a neck assembly, a body portion, and strings.

FIG. 1 is a partially exploded perspective view of a stringed musical instrument 100. While illustrated as a guitar, the instrument 100 may be implemented using any stringed instrument, such as a base, cello, violin, viola, and the like. The instrument 100 includes a neck assembly 110, a body portion 120, and one or more strings 130.

The instrument 100 illustrated is fretted. Thus, the neck assembly 110 includes a fingerboard 140. The fingerboard 140 may include a plurality of longitudinally spaced apart frets 152. However, this is not a requirement.

Figure 5:
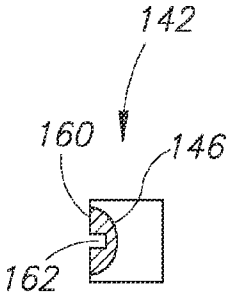
FIG. 5 is cross-sectional view of the neck body taken through line 5-5 of FIG. 2.
Figure 4:
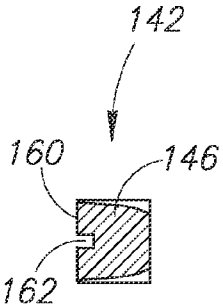
FIG. 4 is cross-sectional view of the neck body taken through line 4-4 of FIG. 2.
Figure 2:
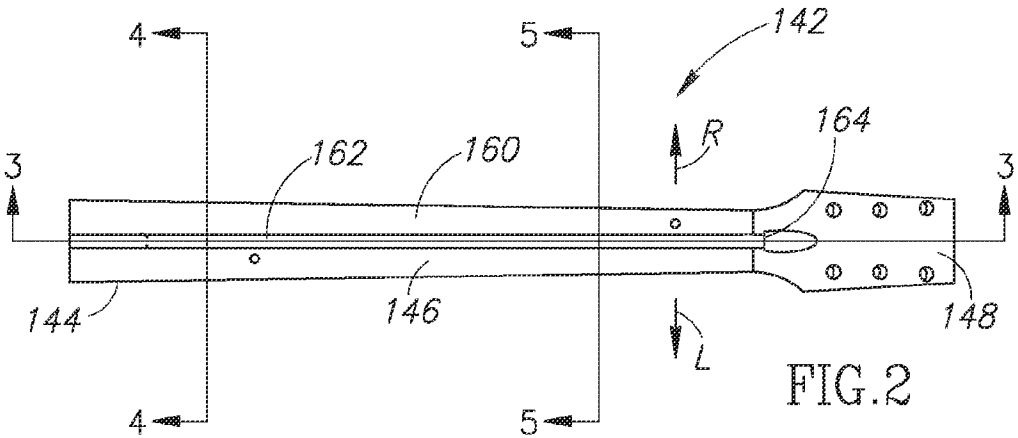
FIG. 2 is front view of a neck body of the neck assembly of FIG. 1.
Figure 3:
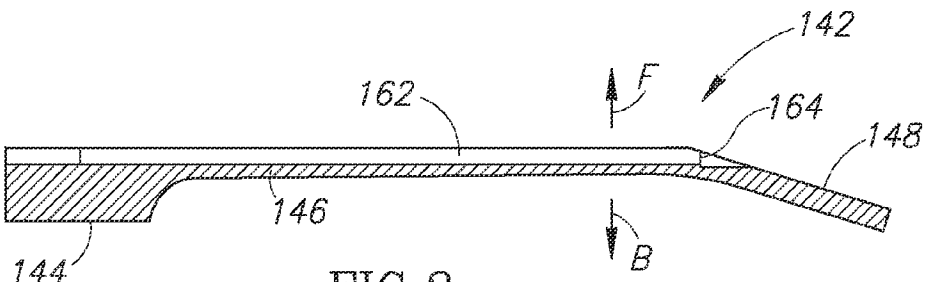
FIG. 3 is cross-sectional view of the neck body taken through line 3-3 of FIG. 2.

The neck assembly 110 illustrated also includes a neck body 142, and a truss rod 150. The neck body 142 has an attachment portion 144, an intermediate portion 146, and a peg head 148. The attachment portion 144 of the neck body 142 is configured for attachment to the body portion 120 of the instrument 100 in a conventional manner. The intermediate portion 146 extends between the attachment portion 144 and the peg head 148. Turning to FIG. 2, the intermediate portion 146 has a forward facing portion 160. A groove 162 is formed in the forward facing portion 160 of the intermediate portion 146. The groove 162 may extend at least partially onto the attachment portion 144 and/or the peg head 148. The groove 162 is substantially straight along the length of the neck body 142. As may be viewed in FIG. 3, the groove 162 has a substantially uniform depth along the attachment and intermediate portions 144 and 146. Further, the groove 162 has a substantially square or rectangular cross-sectional shape as illustrated in FIGS. 4 and 5.

Figure 6:
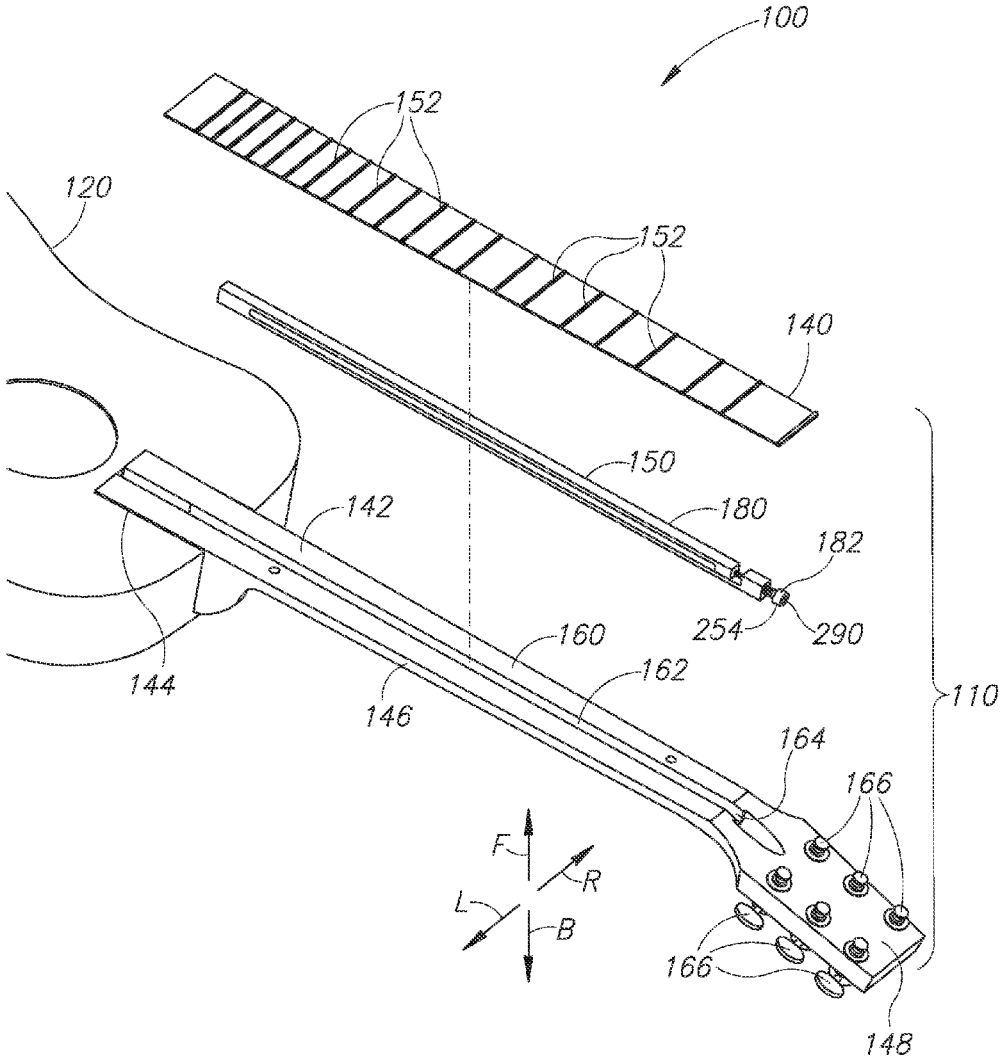
FIG. 6 is an enlarged partially exploded perspective view the instrument of FIG. 1 in which the strings have been omitted.

Turning to FIG. 6, the truss rod 150 is received and housed inside the groove 162. The truss rod 150 may be press-fit into the groove 162 such that the groove 162 holds the truss rod 150 tightly. An optional strip of wood (not shown) may be positioned over the truss rod 150 to help maintain the truss rod 150 inside the groove 162 and help prevent the truss rod 150 from rotating inside the groove 162. In some embodiment, the optional strip of wood (not shown) may be positioned inside the groove 162. The fingerboard 140 is attached to the forward facing portion 160 and covers the groove 162 with the truss rod 150 positioned therein. The groove 162 has an opening 164 positioned at or near the peg head 148 that is accessible from outside the instrument 100 when the fingerboard 140 is attached to the forward facing portion 160 of the neck body 142. A plurality of tuning peg assemblies 166 is mounted on the peg head 148.

Returning to FIG. 1, the body portion 120 includes a bridge assembly 170. Each of the strings 130 extends between the bridge assembly 170 and one of the tuning peg assemblies 166. Thus, the strings 130 extend between the peg head 148 and the body portion 120 of the instrument 100.

As mentioned in the Background Section, the neck body 142 may be bent in any direction, including toward the strings 130 (referred to herein as "forward"), away from the strings (referred to herein as "backward"), sideways in a first direction (referred to herein as "right"), and/or sideways in a second direction (referred to herein as "left") opposite the first direction. The neck assembly 110 may also be bent in more than one direction and/or twisted. The terms "forward," "backward," "right," and "left" have been assigned arbitrarily for the purposes of describing the bending of the neck body 142 of the instrument 100. These terms are not intended to be limiting. In FIGS. 1, 6, 10, and 12-15, an arrow "F" identifies the forward direction, an arrow "B" identifies the backward direction, an arrow "L" identifies the left direction, and an arrow "R" identifies the right direction.

Referring to FIG. 1, the truss rod 150 is configured to bend in the forward direction (identified by the arrow "F"), and in the backward direction (identified by the arrow "B"). The truss rod 150 is sufficiently rigid to prevent the neck body 142 from bending in either the left direction (identified by the arrow "L"), of the right direction (identified by the arrow "R").

Figure 7:
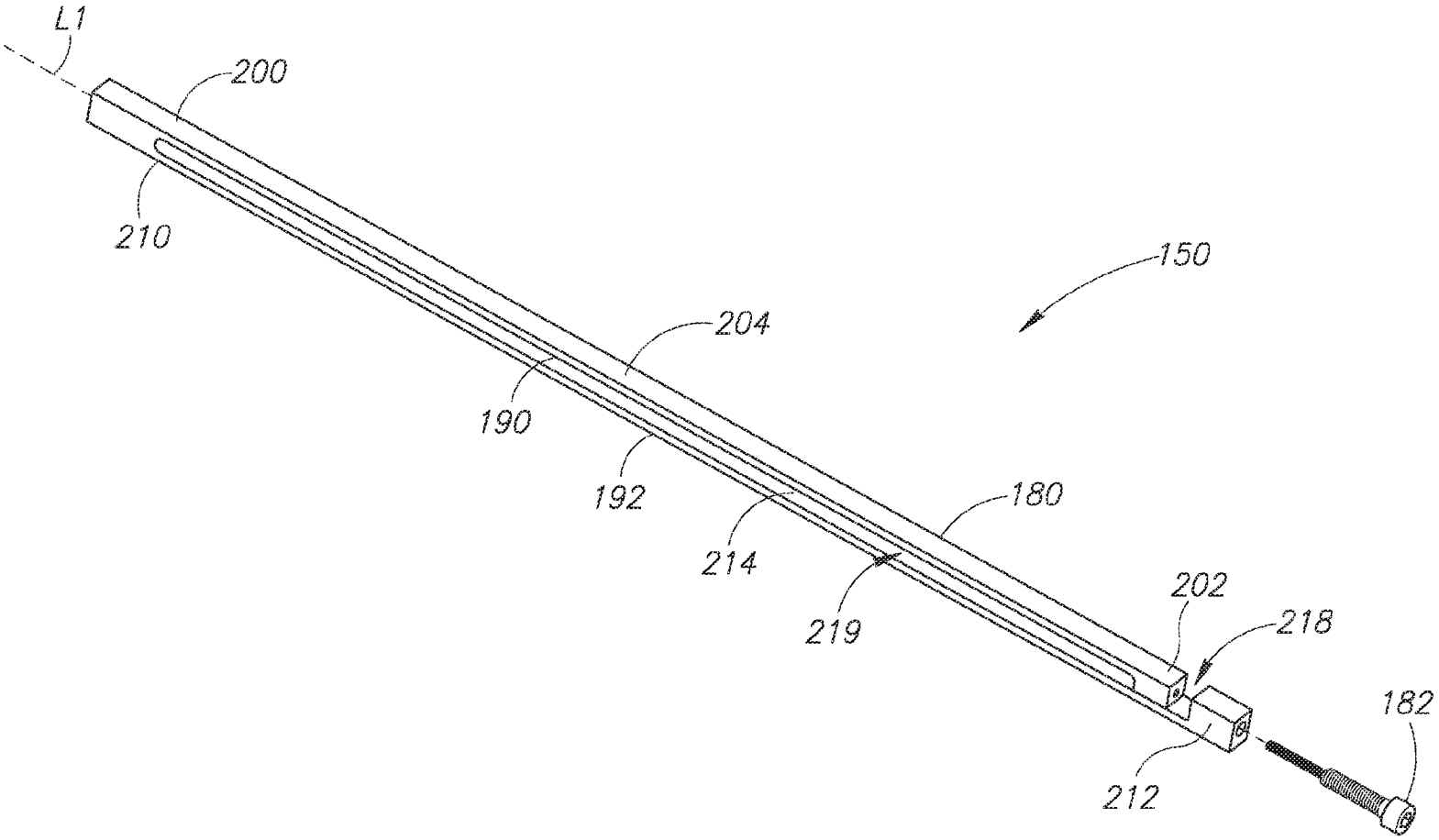
FIG. 7 is an exploded perspective view of a truss rod of the neck assembly illustrated in FIGS. 1 and 6.

FIG. 7 is an exploded perspective view of the truss rod 150. The truss rod 150 includes an elongated body portion 180, and an adjustment member 182. The body portion 180 illustrated has a generally rectilinear outside shape. By way of a non-limiting example, the body portion 180 may be constructed using an aluminum alloy. Aluminum was selected because it is strong and lightweight. In the embodiment illustrated, the body portion 180 has been machined from a single piece of material (e.g., aluminum alloy). However, this is not a requirement. In alternate embodiments, such as the one illustrated in FIGS. 13-15 and described below, the body portion 180 may be constructed from multiple components assembled together.

Referring to FIG. 7, the body portion 180 is elongated and extends along a longitudinal axis "L1." Returning to FIG. 6, the length of the body portion 180 may vary based at least in part on the length of the neck body 142. In addition, the length and thickness of the body portion 180 may be adjusted and/or portions of the body portion 180 stiffened at the manufacturing stage as required to create a particular movement or action at a desired location (e.g., at a particular one of the frets 152) along the neck assembly 110. Thus, the configuration of the body portion 180 may be used to determine or change the playability of the instrument 100 (e.g., guitar), and may be used to adjust the instrument 100 based at least in part on the type or style of music for which the instrument 100 is to be used. In contrast, as mentioned above, prior art double action truss rods can be adjusted only in an arc shape and bent only in the middle.

Turning to FIG. 7, the body portion 180 of the truss rod 150 includes a first rod portion 190 that is substantially parallel to a second rod portion 192. The first and second rod portions 190 and 192 may be elongated and/or rod shaped. The first rod portion 190 has a first end portion 200 opposite a second end portion 202, and an intermediate portion 204 that extends between the first and second end portions 200 and 202. The second rod portion 192 has a first end portion 210 opposite a second end portion 212, and an intermediate portion 214 that extends between the first and second end portions 210 and 212. The first and second rod portions 190 and 192 are fixedly coupled together at their first end portions 200 and 210, respectively. The intermediate portion 204 of the first rod portion 190 extends from the first end portion 200 of the first rod portion 190 alongside the intermediate portion 214 of the second rod portion 192 but stops short of the second end portion 212 of the second rod portion 192. Thus, the second end portion 202 of the first rod portion 190 is spaced apart longitudinally (along the longitudinal axis "L1") from the second end portion 212 of the second rod portion 192 to define a gap 218 therebetween. As will be discussed below, the size of the gap 218 can be adjusted to control the curvature of the first and second rod portions 190 and 192.

The intermediate portions 204 and 214 are spaced apart laterally from one another to define a longitudinally extending gap 219 therebetween. Optionally, a filler or spacer (not shown) may be inserted into the gap 219. However, this is not a requirement. The intermediate portions 204 and 214 each have a rectangular cross-sectional shape.

When the truss rod 150 is positioned inside the groove 162 (see FIG. 6), the first end portions 200 and 210 of the first and second rod portions 190 and 192, respectively, are positioned near or adjacent to the attachment portion 144 (see FIG. 6) of the neck body 142 (see FIG. 6). The second end portion 212 of the second rod portion 192 is adjacent the opening 164 (see FIG. 6) of the groove 162.

Figure 8:
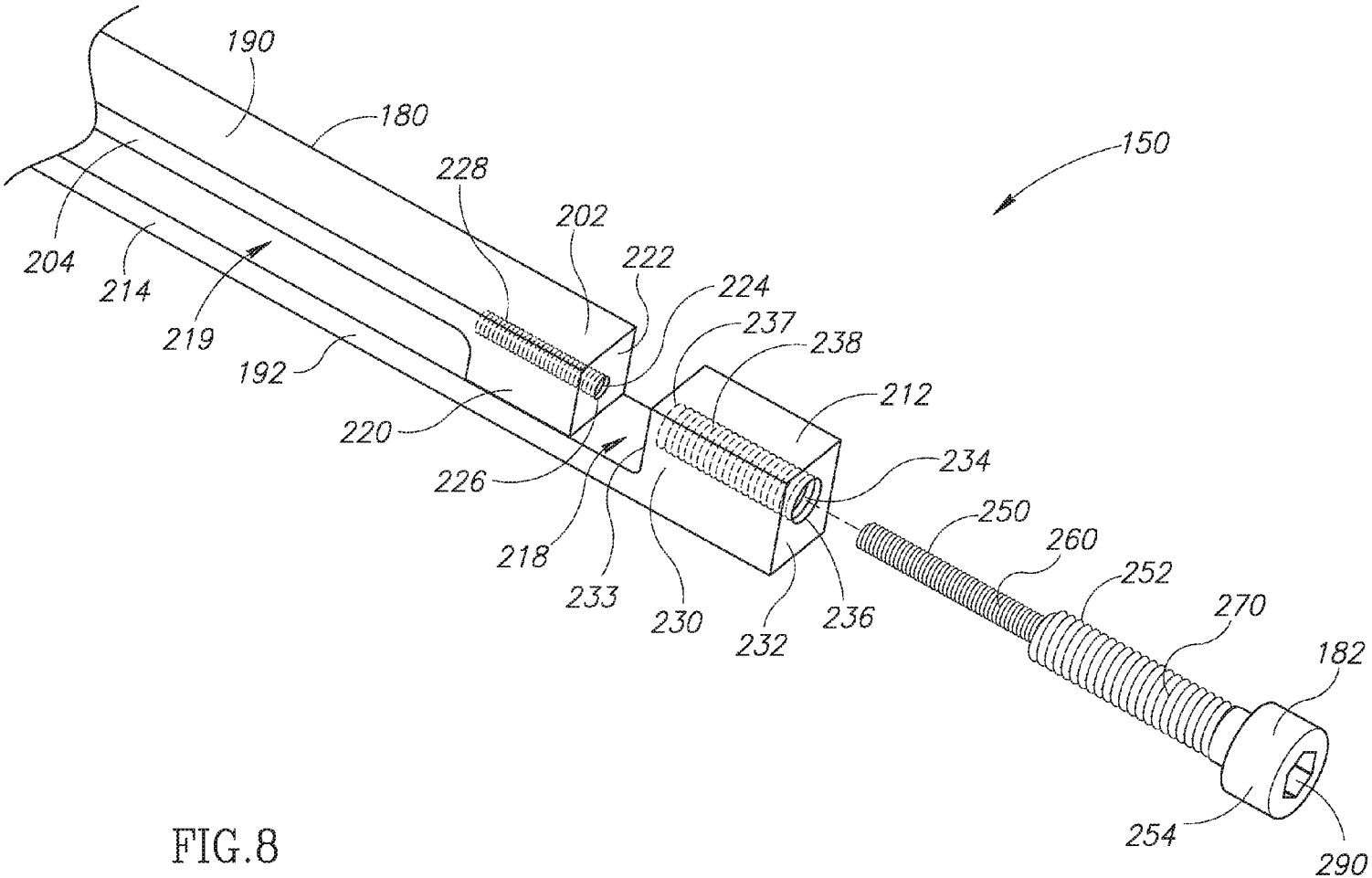
FIG. 8 is an enlargement of a portion of FIG. 3.

Turning to FIG. 8, the second end portion 202 of the first rod portion 190 has a first base portion 220 that projects in the backward direction toward the second rod portion 192. The first base portion 220 is positioned alongside but spaced apart from the intermediate portion 214 of the second rod portion 192. The first base portion 220 is movable with respect to the second rod portion 192. The second end portion 202 has a surface 222 facing toward the second end portion 212 of the second rod portion 192. A first channel 224 is formed in the second end portion 202 of the first rod portion 190. At least a portion of the first channel 224 may be formed in the first base portion 220. The first channel 224 has an opening 226 formed in the surface 222. First inside threads 228 are formed inside the first channel 224.

The second end portion 212 of the second rod portion 192 has a second base portion 230 that projects in the forward direction. The second end portion 212 has a surface 232 that faces away from the second end portion 202 of the first rod portion 190. The second end portion 212 has a surface 233 that is opposite the surface 232 and faces toward the surface 222. A second channel 234 is formed in the second end portion 212 of the second rod portion 192. At least a portion of the second channel 234 may be formed in the second base portion 230. The second channel 234 extends between the surfaces 232 and 233. The second channel 234 has a first opening 236 formed in the first surface 232 and a second opening 237 formed in the second surface 233. Second inside threads 238 are formed inside the second channel 234. The second channel 234 is aligned with the first channel 224 so that the adjustment member 182 may be received into both the first and second channels at the same time.

The adjustment member 182 includes a proximal portion 250, an intermediate portion 252, and a distal portion 254. In the embodiment illustrated, the adjustment member 182 has been implemented as a dual pitch metal screw or bolt configured to provide sufficient adjustability and/or mechanical advantage.

The proximal portion 250 includes first outside threads 260 having a first thread pitch. The proximal portion 250 is configured to pass through the open-ended second channel 234 and be received inside the opening 226 of the first channel 224. The first outside threads 260 are configured to thread into the first inside threads 228 of the first channel 224.

The intermediate portion 252 includes second outside threads 270 having a second thread pitch. The intermediate portion 252 is configured to be received inside the first opening 236 formed in the first surface 232. The second outside threads 270 are configured to thread into the second inside threads 238 of the second channel 234. In the embodiment illustrated, the intermediate portion 252 has a sufficiently large minimum outside dimension (e.g., diameter) to prevent the intermediate portion 252 from entering the opening 226 of the first channel 224.

In some embodiments, such as embodiments in which the adjustment member 182 is implemented as a dual pitch screw or bolt, the first thread pitch is different from the second thread pitch. In the embodiment illustrated, the first thread pitch is less than the second thread pitch. For example, the second thread pitch may be twice the first thread pitch. In the embodiment illustrated, the first outside threads 260 and the second outside threads 270 extend in the same direction (e.g., clockwise) along the proximal and intermediate portions 250 and 252, respectively. However, this is not a requirement. In alternate embodiments, the first outside threads 260 and the second outside threads 270 extend in opposite directions along the proximal and intermediate portions 250 and 252, respectively.

Figure 9:
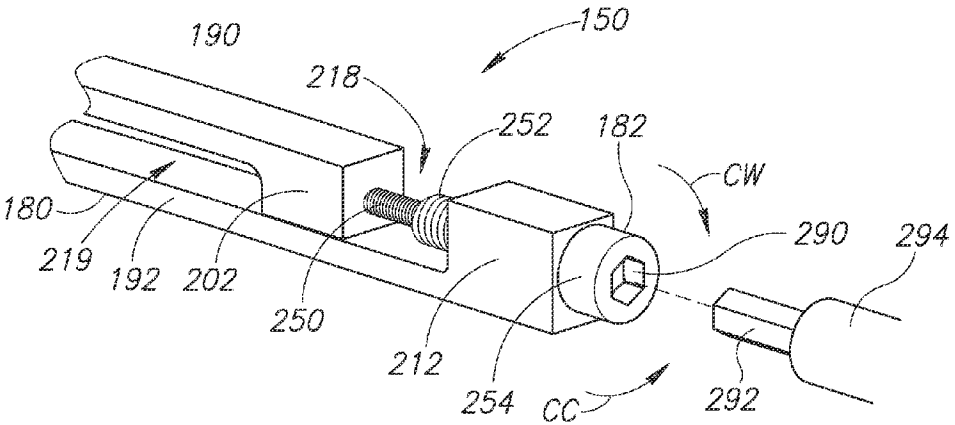
FIG. 9 is a perspective view of an adjustment member received fully in a body portion of the truss rod.

The distal portion 254 has a keyway 290 formed therein. The distal portion 254 may be implemented as a conventional screw head or bolt head. Turning to FIG. 9, the keyway 290 is configured to receive a key portion 292 of a tool 294 (e.g., a hexagonal screwdriver or bit). In alternate embodiments, the distal portion 254 may include a key portion (not shown) configured to be received by a keyway portion (not shown) of a tool (not shown). Thus, the distal portion 254 includes a first connector (e.g., the keyway 290) configured to engage or mate with a second connector (e.g., the key portion 292) of the tool 294. When the first and second connectors are engaged, the tool 294 and the adjustment member 182 may be rotated together as a unit.

When the adjustment member 182 rotates in a first rotational direction (e.g., clockwise) depicted by an arrow "CW," the adjustment member 182 threads further into the first and second channels 224 and 234 (see FIG. 8). However, as may be viewed in FIG. 8, because the first thread pitch is less than the second thread pitch, the intermediate portion 252 longitudinally traverses the second channel 234 a greater distance than the proximal portion 250 longitudinally traverses the first channel 224. Thus, referring to FIGS. 9 and 10, the adjustment member 182 pushes on the second end portion 202 of the first rod portion 190 and widens the gap 218. This may cause the truss rod 150 to curve toward the forward direction (indicated by the arrow "F") and/or away from the backward direction (indicated by the arrow "B"). In other words, when viewed from the front, the truss rod 150 may curve convexly.

Figure 11:
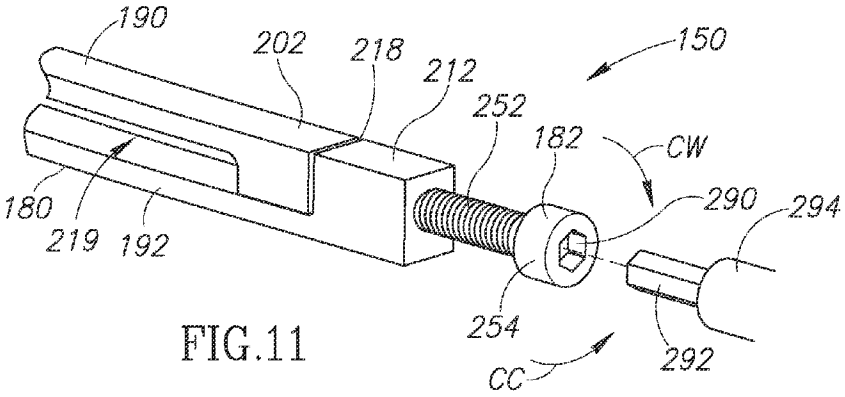
FIG. 11 is a perspective view of the truss rod in which a second end portion of a first rod portion abuts (or otherwise cannot to travel any closer to) a second end portion of a second rod portion.
Figure 12:
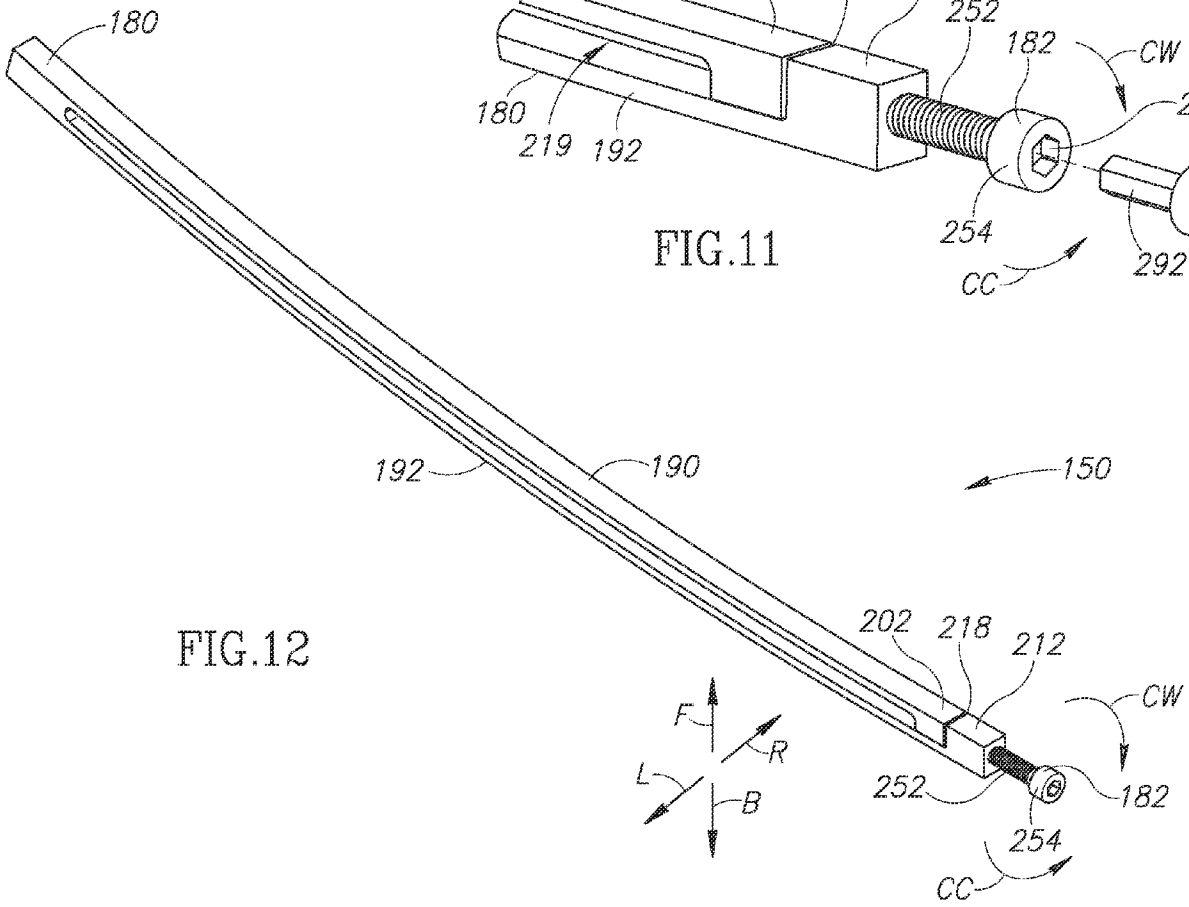
FIG. 12 is a perspective view of the truss rod bent backwardly by a maximum amount.

On the other hand, when the adjustment member 182 rotates in a second rotational direction (e.g., counter clockwise) depicted by an arrow "CC," the adjustment member 182 threads outwardly from the first and second channels 224 and 234 (see FIG. 8) toward the peg head 148 (see FIGS. 1 and 6). Because the first thread pitch is less than the second thread pitch, the intermediate portion 252 longitudinally traverses the second channel 234 (see FIG. 8) a greater distance than the proximal portion 250 (see FIG. 8) longitudinally traverses the first channel 224 (see FIG. 8) as shown in FIGS. 11 and 12. Thus, the adjustment member 182 pulls the second end portion 202 of the first rod portion 190 toward the second end portion 212 of the second rod portion 192 and narrows the gap 218. This may cause the truss rod 150 to curve away from the forward direction (indicated by the arrow "F") and/or toward the backward direction (indicated by the arrow "B"). In other words, when viewed from the front, the truss rod 150 may curve concavely.

Figure 10:
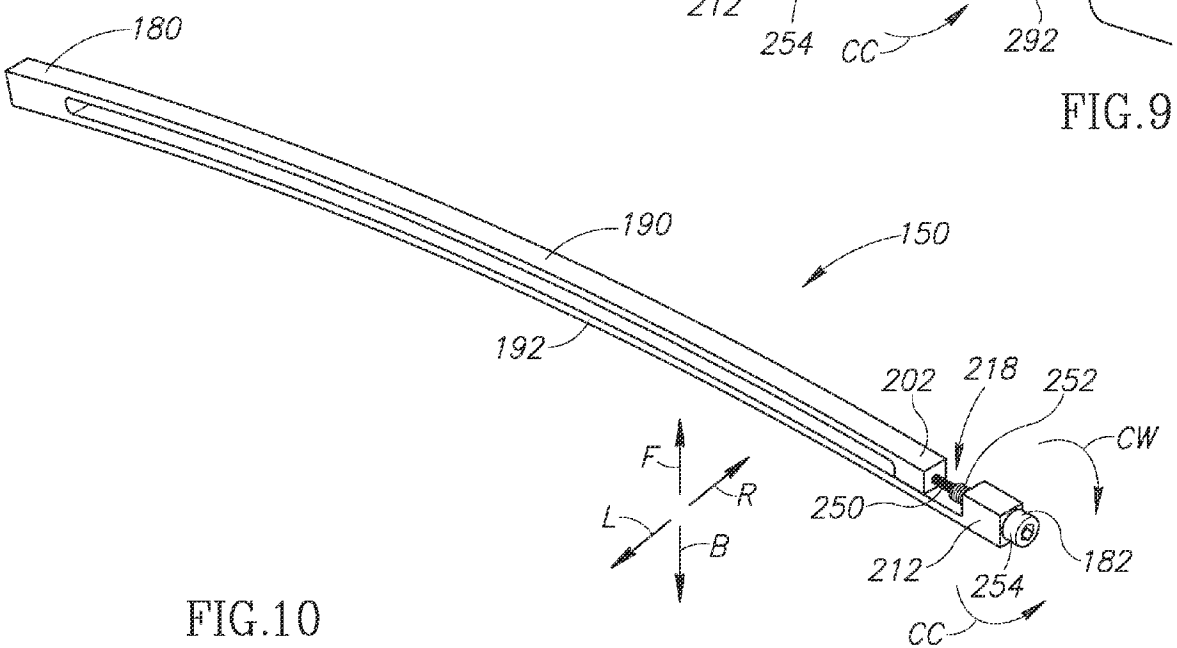
FIG. 10 is a perspective view of the truss rod bent forwardly by a maximum amount.

As the adjustment member 182 is rotated in the first or second rotational directions (identified by arrows "CW" and "CC," respectively), the shape of the body portion 180 changes. For example, if the body portion 180 is curved toward the forward direction (indicated by the arrow "F") as illustrated in FIG. 10, the adjustment member 182 may be rotated the second rotational direction (indicated by the arrow "CC") to change the curvature of the body portion 180. If the adjustment member 182 is rotated sufficiently in the second rotational direction (indicated by the arrow "CC"), the body portion 180 may curve toward the backward direction (indicated by the arrow "B") as illustrated in FIG. 12. Similarly, if the body portion 180 curves toward the backward direction (indicated by the arrow "B") as illustrated in FIG. 12, the adjustment member 182 may be rotated the first rotational direction (indicated by the arrow "CW") to change the curvature of the body portion 180. If the adjustment member 182 is rotated sufficiently in the first rotational direction (indicated by the arrow "CW"), the body portion 180 may curve toward the forward direction (indicated by the arrow "F") as illustrated in FIG. 10.

The body portion 180 is depicted in FIGS. 9 and 10 having a maximum amount of forward curvature because the adjustment member 182 is fully threaded into the first and second channels 224 and 234 such that the distal portion 254 of the adjustment member 182 abuts the second end portion 212 of the second rod portion 192. On the other hand, the body portion 180 is depicted in FIGS. 11 and 12 having a maximum amount of backward curvature because the second end portion 202 of the first rod portion 190 abuts (otherwise cannot travel any closer to) the second end portion 212 of the second rod portion 192. The adjustment member 182 may be rotated in the first or second rotational directions (identified by arrows "CW" and "CC," respectively), to obtain curvatures between the maximum amounts of backward and forward curvatures.

Turning again to FIG. 6, as mentioned above, the truss rod 150 is installed in the groove 162 of the neck body 142. The fingerboard 140 is positioned over the groove 162 with the truss rod 150 therein and adhered to the forward facing portion 160 of the neck body 142. Thus, the truss rod 150 is sealed inside the groove 162 and when so positioned, the body portion 180 is non-rotatable with respect to the neck body 142.

The keyway 290 of the adjustment member 182 is positioned in the opening 164 to be accessible outside the neck body 142. The key portion 292 (see FIGS. 9 and 11) of the tool 294 may be inserted into the keyway 290 of the adjustment member 182 via the opening 164. As explained above, by rotating the tool 294, the adjustment member 182 may be rotated with respect to the body portion 180.

Because the body portion 180 is non-rotatable with respect to the neck body 142, when the adjustment member 182 is rotated with respect to the body portion 180, the body portion 180 of the truss rod 150 tries to curve as illustrated in FIGS. 10 and 12. As the body portion 180 tries to curve, the body portion 180 exerts forces on the neck body 142 and/or the fingerboard 140. The forces exerted by the body portion 180 on the neck body 142 and/or the fingerboard 140 may change the shape of the neck body 142 and/or the fingerboard 140. Thus, if the neck body 142 and the fingerboard 140 are curved forwardly (e.g., have a convex curvature when viewed from the front), the user may straighten or achieve a desired amount of curvature by rotating the adjustment member 182 in the second rotational direction (indicated by the arrow "CC" in FIG. 10), which will cause the body portion 180 to curve toward the backward direction (indicated by the arrow "B") and exert backwardly directed forces on the neck body 142 and/or the fingerboard 140. Conversely, if the neck body 142 and the fingerboard 140 are curved backwardly (e.g., have a concave curvature when viewed from the front), the user may straighten or achieve a desired amount of curvature by rotating the adjustment member 182 in the first rotational direction (indicated by the arrow "CW" illustrated in FIG. 12), which will cause the body portion 180 to curve toward the forward direction (indicated by the arrow "F") and exert forwardly directed forces on the neck body 142 and/or the fingerboard 140.

Thus, the adjustment member 182 may be characterized as exerting a longitudinally directed force (substantially parallel to the longitudinal axis "L1") on the second end portion 202 of the first rod portion 190. The longitudinally directed force causes the first rod portion 190 to exert a first laterally directed force (in the forward or backward directions) on the first end portion 210 of the second rod portion 192. The first laterally directed force causes the second rod portion 192 (and the first rod portion 190) to exert a second laterally directed force (in the forward or backward directions) on the neck body 142 and/or the fingerboard 140. The second laterally directed force may change the curvature of the neck body 142 and/or the fingerboard 140.

The body portion 180 is substantially straight with respect to the right and left directions (identified by the arrows "R" and "L," respectively). Because the body portion 180 is non-rotatable inside the groove 162, the body portion 180 maintains the straightness of the neck body 142 with respect to the right and left directions (identified by the arrows "R" and "L," respectively). Thus, unlike prior art truss rods that may rotate inside the neck of an instrument, the truss rod 150 prevents the neck body 142 from curving in the right and left directions while allowing the neck body 142 to bend in the forward and backward directions, as required. This allows the neck body 142 to be adjusted and/or tuned and preserves the playability of the instrument 100.

Alternate Embodiment

Figure 13:
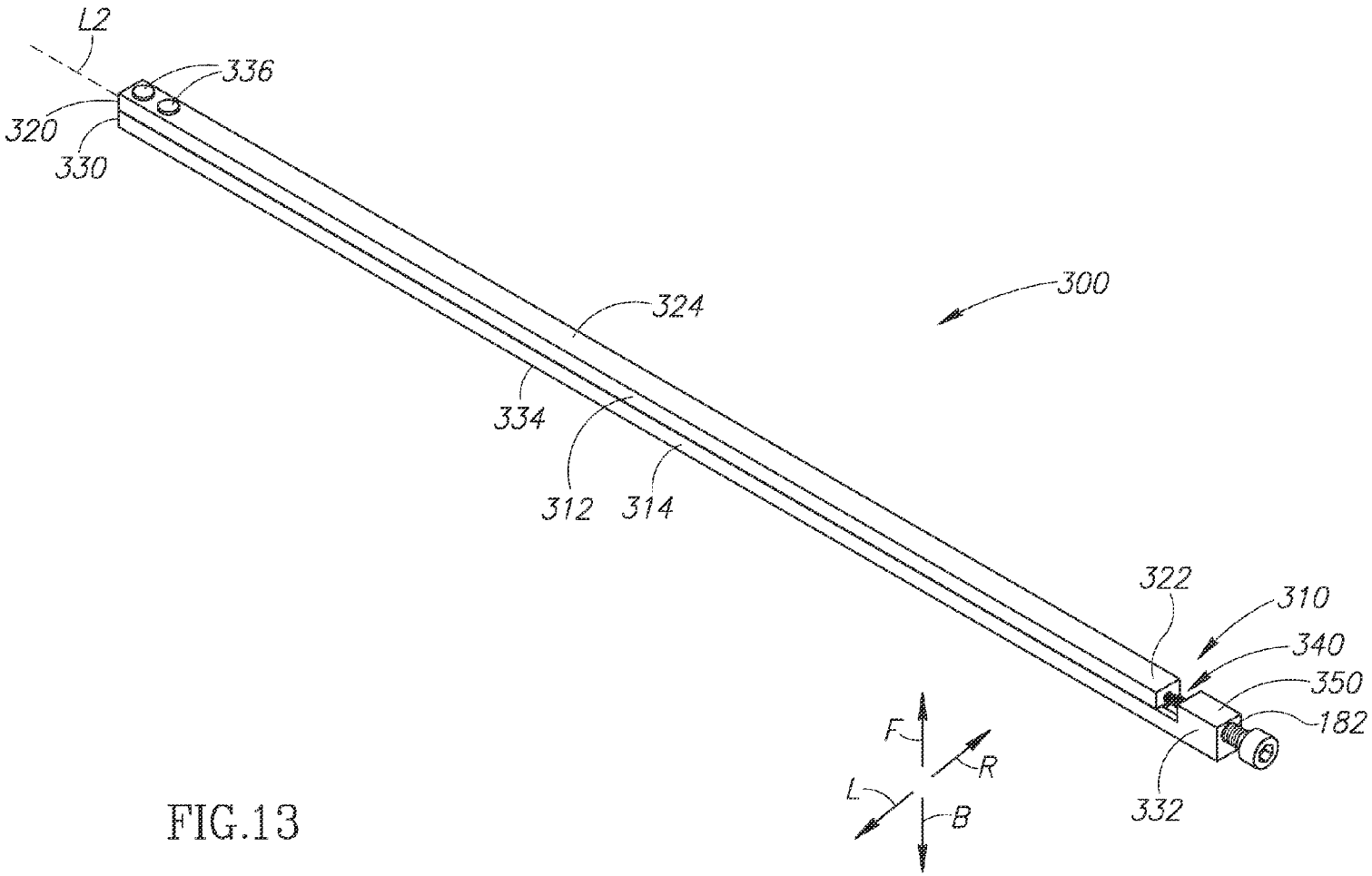
FIG. 13 is a perspective view of a second embodiment of a truss rod.
Figure 14:
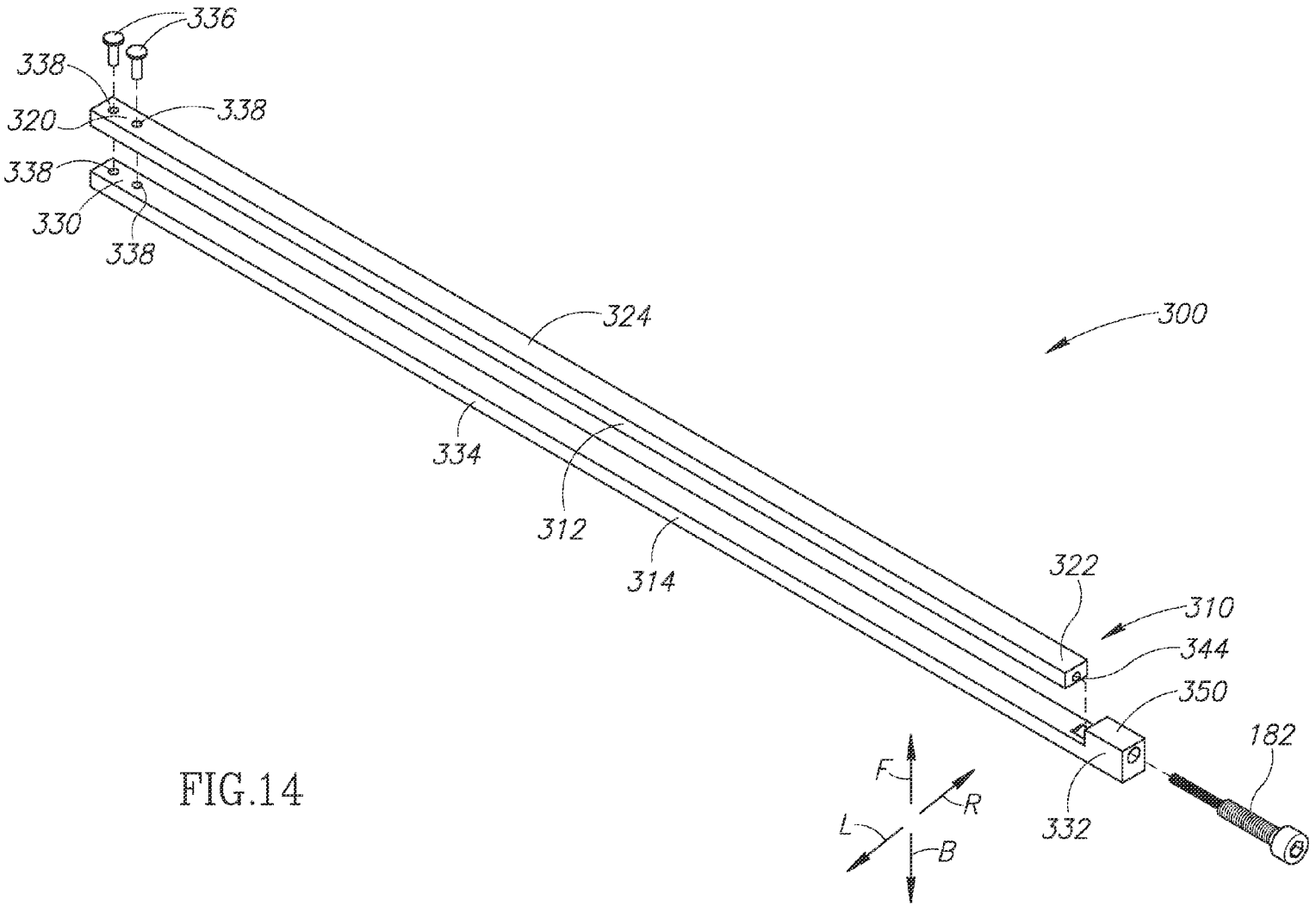
FIG. 14 is an exploded perspective view of the truss rod of FIG. 13.
Figure 15:
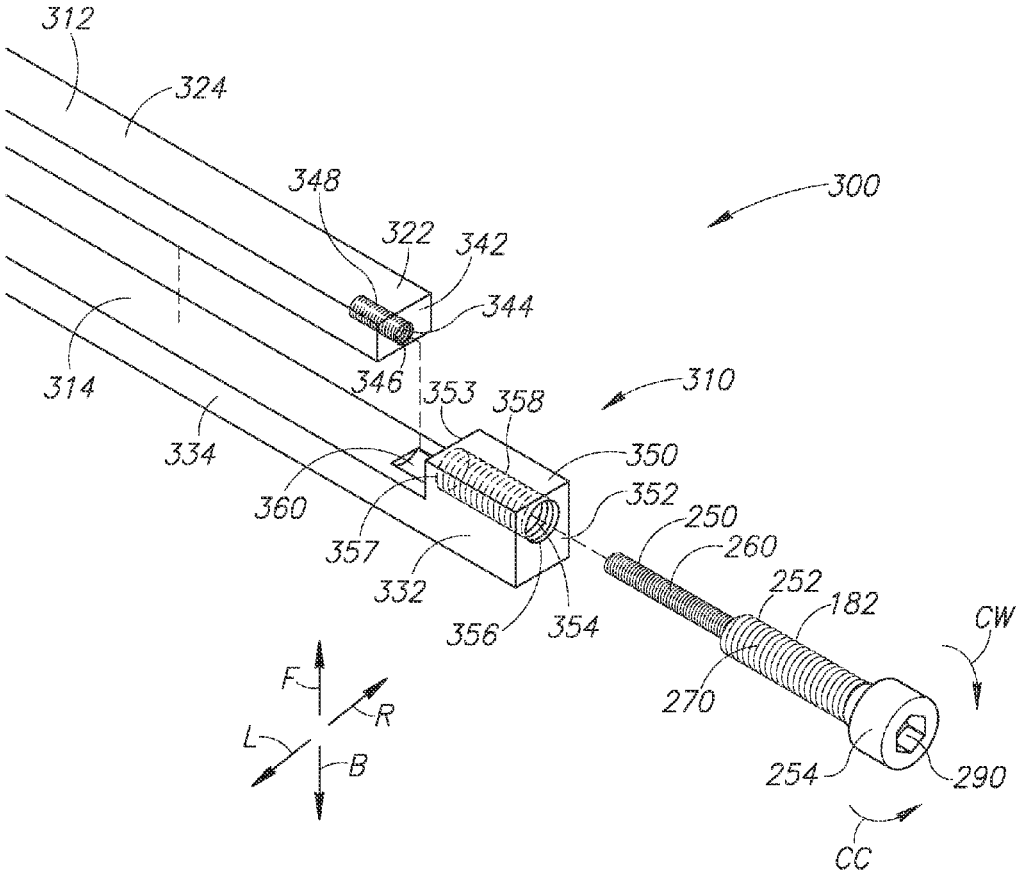
FIG. 15 is an enlargement of portion of FIG. 14.

FIGS. 13-15 depict a truss rod 300 that is an alternate embodiment of the truss rod 150 depicted in FIGS. 1 and 6-12. Like reference numerals have been used to identify like components in FIGS. 1 and 6-15. The truss rod 300 may replace the truss rod 150 (see FIG. 1) in the instrument 100 (see FIG. 1). Like the truss rod 150, the truss rod 300 is configured to bend in the forward direction (identified by the arrow "F"), and in the backward direction (identified by the arrow "B"). The truss rod 300 is sufficiently rigid to prevent the neck assembly 110 (see FIG. 1) from bending in either the left direction (identified by the arrow "L"), of the right direction (identified by the arrow "R").

Turning to FIG. 13, the truss rod 300 includes the adjustment member 182 and an elongated body assembly 310. When assembled, the body assembly 310 provides substantially identical functionality to that provided by the body portion 180 (see FIGS. 1 and 6-12) of the truss rod 150. However, instead of being formed from a single piece of material (e.g., aluminum alloy), the body assembly 310 includes a first rod 312 and a separate second rod 314.

The elongated body assembly 310 extends along a longitudinal axis "L2." The body assembly 310 illustrated has a generally rectilinear outside shape. The first rod 312 extends alongside and is substantially parallel to the second rod 314. In the embodiment illustrated, the first and second rods 312 and 314 each have a substantially rectangular cross-sectional shape. By way of a non-limiting example, the first and second rods 312 and 314 may each be constructed using an aluminum alloy.

Like the body portion 180 (see FIGS. 6-12) of the truss rod 150, the length of the body assembly 310 may vary based at least in part on the length of the neck body 142 (see FIGS. 1-6). In addition, the length and thickness of the first rod 312 and/or the second rod 314 may be adjusted and/or portions of the first rod 312 and/or the second rod 314 may be stiffened at the manufacturing stage as required to create a particular movement or action at a desired location (e.g., at a particular one of the frets 152 illustrated in FIGS. 1 and 6) along the neck assembly 110 (see FIGS. 1 and 6). Thus, the configuration of the body assembly 310 may be used to determine or change the playability of the instrument 100 (e.g., guitar), and may be used to adjust the instrument 100 based at least in part on the type or style of music for which the instrument 100 is to be used.

The first rod 312 has a first end portion 320 opposite a second end portion 322, and an intermediate portion 324 that extends between the first and second end portions 320 and 322. The second rod 314 has a first end portion 330 opposite a second end portion 332, and an intermediate portion 334 that extends between the first and second end portions 330 and 332. The first and second rods 312 and 314 are connected together at their first end portions 320 and 330, respectively. In the embodiment illustrated, the first end portions 320 and 330 are coupled together by one or more fasteners 336. However, this is not requirement. In alternate embodiments, the first end portions 320 and 330 may be connected together using alternate means. For example, the first end portions 320 and 330 may be adhered or welded together. Referring to FIG. 14, optionally, the first end portions 320 and 330 may each include one or more through-holes 338 configured to receive the one or more fasteners 336.

Returning to FIG. 13, the intermediate portion 324 of the first rod 312 extends from the first end portion 320 of the first rod 312 alongside the intermediate portion 334 of the second rod 314 but stops short of the second end portion 332 of the second rod 314. Thus, the second end portion 322 of the first rod 312 is spaced apart longitudinally (along the longitudinal axis "L2") from the second end portion 332 of the second rod 314 to define a gap 340 therebetween.

The intermediate portions 324 and 334 of the first and second rods 312 and 314, respectively, are positioned immediately alongside one another. When the adjustment member 182 is rotated with respect to the body assembly 310, at least one of the intermediate portions 324 and 334 slides along the other.

Turning to FIG. 15, the second end portion 322 has a surface 342 facing toward the second end portion 332 of the second rod 314. A first channel 344 is formed in the second end portion 322 of the first rod 312. The first channel 344 has an opening 346 formed in the surface 342. First inside threads 348 are formed inside the first channel 344.

The second end portion 332 of the second rod 314 has a base portion 350 that projects in the forward direction. The second end portion 332 has a surface 352 that faces away from the second end portion 322 of the first rod 312. The second end portion 332 has a surface 353 that is opposite the surface 352 and faces toward the surface 342. A second channel 354 is formed in the second end portion 332 of the second rod 314. At least a portion of the second channel 354 may be formed in the base portion 350. The second channel 354 extends between the surfaces 352 and 353. The second channel 354 has a first opening 356 formed in the first surface 352 and a second opening 357 formed in the second surface 353. Second inside threads 358 are formed inside the second channel 354. The second channel 354 is aligned with the first channel 344 so that the adjustment member 182 may be received into both the first and second channels at the same time. In the embodiment illustrated, the second channel 354 extends partially into the intermediate portion 334 forming a groove 360 therein. However, this is not a requirement.

The second channel 354 is configured to allow the proximal portion 250 to pass therethrough to be received inside the opening 346 of the first channel 344. The first outside threads 260 are configured to thread into the first inside threads 348 of the first channel 344. The intermediate portion 252 is configured to be received inside the first opening 356 formed in the first surface 352. The second outside threads 270 are configured to thread into the second inside threads 358 of the second channel 354. In the embodiment illustrated, the intermediate portion 252 has a sufficiently large minimum outside dimension (e.g., diameter) to prevent the intermediate portion 252 from entering the opening 346 of the first channel 344.

When the adjustment member 182 rotates in the first rotational direction (e.g., clockwise) depicted by an arrow "CW," the adjustment member 182 threads further into the first and second channels 344 and 354, pushing the second end portion 322 of the first rod 312 and widening the gap 340 (see FIG. 13). This may cause the truss rod 300 to curve toward the forward direction (indicated by the arrow "F") and/or away from the backward direction (indicated by the arrow "B"). In other words, when viewed from the front, the truss rod 300 may curve convexly.

On the other hand, when the adjustment member 182 rotates in the second rotational direction (e.g., counter clockwise) depicted by an arrow "CC," the adjustment member 182 threads outwardly from the first and second channels 344 and 354 toward the peg head 148 (see FIGS. 1-3 and 6), pulling the second end portion 322 of the first rod 312 toward the second end portion 332 of the second rod 314 and narrowing the gap 340 (see FIG. 13). This may cause the truss rod 300 to curve away from the forward direction (indicated by the arrow "F") and/or toward the backward direction (indicated by the arrow "B"). In other words, when viewed from the front, the truss rod 300 may curve concavely.

Thus, as the adjustment member 182 is rotated in the first or second rotational directions (identified by arrows "CW" and "CC," respectively), the shape of the body assembly 310 changes. Because the body assembly 310 is non-rotatable with respect to the neck body 142 (see FIGS. 1 and 6), when the adjustment member 182 is rotated with respect to the body assembly 310, the body assembly 310 of the truss rod 300 tries to curve. As the body assembly 310 tries to curve inside the groove 162 (see FIGS. 1 and 6), the body assembly 310 exerts forces on the neck body 142 and/or the fingerboard 140 (see FIGS. 1 and 6). The forces exerted by the body assembly 310 on the neck body 142 and/or the fingerboard 140 change the shape of the neck body 142. Further, because the body portion 180 is non-rotatable inside the groove 162, the body portion 180 maintains the straightness of the neck body 142 with respect to the right and left directions (identified by the arrows "R" and "L," respectively). Thus, the truss rod 300 prevents the neck body 142 from curving in the right and left directions while allowing the neck body 142 to bend in the forward and backward directions, as required. This allows the neck body 142 to be adjusted and/or tuned and preserves the playability of the instrument 100.

In embodiments in which the adjustment member 182 is implemented using a dual pitch screw or bolt, the truss rod 150 and/or the truss rod 300 may not be as thick or as heavy as prior art truss rods configured to produce the same amount of torque. This makes instruments (e.g., the instrument 100) that incorporate either the truss rod 150 or the truss rod 300 desirable because such instruments may be more playable than heavier instruments that incorporate prior art double action truss rods.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A truss rod comprising:

a body portion having a first elongated portion and a second elongated portion, the body portion having a shape; the first elongated portion having a first end portion opposite a second end portion, the second elongated portion having a first end portion opposite a second end portion, the first end portions of the first and second elongated members being coupled together, the second end portion of the first elongated portion being movable with respect to the second elongated member; and a rotatable adjustment member threadedly engaged with the second end portions of both the first and second elongated members, rotation of the adjustment member in a first rotation direction causing the second end portion of the first elongated member to move in a first direction with respect to the second end portion of the second elongated member to thereby selectively alter the shape of the body portion, and rotation of the adjustment member in a second rotation direction opposite the first rotation direction causing the second end portion of the first elongated member to in a second direction with respect to the second end portion of the second elongated member to thereby selectively alter the shape of the body portion.

2. The truss rod of claim 1, wherein rotating the adjustment member in the first rotation direction bends both the first and second elongated members in a first bend direction, and rotating the adjustment member in the second rotation direction bends both the first and second elongated members in a second bend direction, the first bend direction being opposite the second bend direction.

3. The truss rod of claim 2, wherein the first and second elongated members are configured to resist bending in directions orthogonal to the first and second bend directions.

4. The truss rod of claim 1, wherein the movable adjustment member is a dual pitch screw.

5. The truss rod of claim 4, wherein the dual pitch screw has a first portion with first outside threads, and a second portion with second outside threads, the first outside threads have a first thread pitch, the second outside threads have a second thread pitch, the first outside threads engage the second end portion of the first elongated member, and the second outside threads engage the second end portion of the second elongated member.

6. The truss rod of claim 5, wherein the first pitch is less than the second pitch.

7. The truss rod of claim 6, wherein the second pitch is twice the first pitch.

8. The truss rod of claim 1, wherein the first elongated portion is shorter than the second elongated portion.

9. The truss rod of claim 1, wherein the body portion is constructed from an aluminum alloy.

10. The truss rod of claim 1 for use with a groove formed in a neck body of a musical instrument, wherein the truss rod is configured to be received inside the groove and when so received, to be non-rotatable inside the groove when the adjustment member is rotated.

11. The truss rod of claim 1, wherein the body portion has a rectilinear shape.

12. A truss rod for use with a neck body of a musical instrument, the neck body having curvature, the truss rod comprising:

a first rod portion;

a second rod portion connected to the first rod portion; and an adjustment member connected to the first rod portion, the adjustment member being configured to exert a longitudinally directed force on the first rod portion that causes the first rod portion to move longitudinally with respect to the second rod portion, the movement of the first rod portion with respect to the second rod portion exerting a first laterally directed force on the second rod portion, the first laterally directed force being configured to cause the second rod portion to exert a second laterally directed force on the neck body to thereby change the curvature of the neck body.

13. The truss rod of claim 12, wherein the first rod portion is shorter than the second rod portion.

14. The truss rod of claim 12, wherein the adjustment member threadedly engages the first rod portion and exerts the longitudinally directed force on the first rod portion by threading into or out of the first rod portion.

15. The truss rod of claim 14, wherein the adjustment member threadedly engages the second rod portion, the threaded engagement of the adjustment member with the first rod portion having a first thread pitch, and the threaded engagement of the adjustment member with the second rod portion having a second thread pitch, the first thread pitch being different from the second thread pitch.

16. A musical instrument comprising:

a body portion;

a neck assembly coupled to the body portion, the neck assembly comprising a neck body housing a truss rod, the neck body having a curvature, the truss rod comprising a first rod portion, a second rod portion, and an adjustment member, the first rod portion being connected to the second rod portion, the adjustment member being connected to the first rod portion and configured to exert a longitudinally directed force on the first rod portion that causes the first rod portion to move longitudinally with respect to the second rod portion, the movement of the first rod portion with respect to the second rod portion exerting a first laterally directed force on the second rod portion that causes at least one of the first and second rod portions to exert a second laterally directed force on the neck body changing the curvature of the neck body; and one or more strings, each having a first end and a second end, the first end being attached to the body portion and the second end being attached to the neck assembly.

17. The musical instrument of claim 16, wherein the adjustment member threadedly engages the first rod portion and exerts the longitudinally directed force on the first rod portion by threading into or out of the first rod portion.

18. The musical instrument of claim 17, wherein the adjustment member threadedly engages the second rod portion, the threaded engagement of the adjustment member with the first rod portion having a first thread pitch, and the threaded engagement of the adjustment member with the second rod portion having a second thread pitch, the first thread pitch being different from the second thread pitch.

19. The musical instrument of claim 16, wherein the first and second rod portions are connected together by one or more laterally extending fasteners.

20. The musical instrument of claim 16, wherein the first and second rod portions are formed as a unit from a single piece of material.

21. The musical instrument of claim 16, wherein the first rod portion is shorter than the second rod portion.

22. The musical instrument of claim 16, wherein the first and second rod portions are constructed from an aluminum alloy.

23. The musical instrument of claim 16, wherein the neck body comprises a groove, the truss rod is housed inside the groove, and non-rotatable with respect to the groove.

* * * * *